US010188566B2

(12) United States Patent
Drake

(10) Patent No.: US 10,188,566 B2
(45) Date of Patent: Jan. 29, 2019

(54) LIFTING MECHANISM

(71) Applicant: Accora Limited, Cambridge (GB)

(72) Inventor: Laurie Drake, Cambridge (GB)

(73) Assignee: ACCORA LIMITED (GB)

( * ) Notice: Subject to any disclaimer, the term of this patent is extended or adjusted under 35 U.S.C. 154(b) by 320 days.

(21) Appl. No.: 15/339,628

(22) Filed: Oct. 31, 2016

(65) Prior Publication Data

US 2018/0116884 A1 May 3, 2018

(51) Int. Cl.

| | |
|---|---|
| ***A61G 7/012*** | (2006.01) |
| ***B66F 11/00*** | (2006.01) |
| ***A61G 7/018*** | (2006.01) |

(52) U.S. Cl.

CPC ..... *A61G 7/012* (2013.01); *A61G 7/018* (2013.01); *B66F 11/00* (2013.01); *B66F 2700/09* (2013.01)

(58) Field of Classification Search

CPC ..... A61G 7/012; B66F 11/00

(Continued)

(56) References Cited

U.S. PATENT DOCUMENTS 3,272,286 A * 9/1966 Leduc ..... E04F 21/1822 187/244
3,507,535 A * 4/1970 Wallace ..... B60P 3/32 296/173

(Continued)

FOREIGN PATENT DOCUMENTS

| | | | |
|---|---|---|---|
| EP | 1543744 | 6/2005 | ..... A47B 9/12 |
| WO | WO9919247 | 4/1999 | ..... B66F 7/00 |
| WO | WO03070145 | 8/2003 | ..... A61G 7/012 |

OTHER PUBLICATIONS

European Search Report issued in application No. 15189713.9, dated Aug. 18, 2016 (7 pgs).

(Continued)

*Primary Examiner* — Fredrick C Conley
(74) *Attorney, Agent, or Firm* — Hayes Soloway P.C.

(57) ABSTRACT

This invention relates to lifting mechanisms. In particular this invention relates to lifting mechanisms for use in healthcare equipment such as beds. A lifting assembly comprises a telescopic post assembly including a first tubular member, a second tubular member slidingly engaged with the first tubular member, and a third tubular member slidingly engaged with the second tubular member, the first, second and third tubular members being coaxial; an actuator configured to move the second tubular member axially with respect to the first tubular member; and a pulley mechanism comprising a first wheel rotatably mounted at a first end of the second tubular member; a second wheel rotatably mounted at a second end of the second tubular member; a first length of cable having a first end fixed to the first tubular member and a second end fixed to the third tubular member, the first length of cable being engaged with the first wheel; and a second length of cable having a first end fixed to the first tubular member and a second end fixed to the third tubular member, the second length of cable being engaged with the second wheel, wherein the pulley mechanism is arranged such that the movement of the third tubular member relative to the first tubular member is at a greater speed than the movement of the second tubular member relative to the first tubular member.

19 Claims, 7 Drawing Sheets

(58) Field of Classification Search
USPC ..... 5/11, 611; 254/2 C, 4 R, 325
See application file for complete search history.

(56) References Cited

U.S. PATENT DOCUMENTS

2007/0192960 A1* 8/2007 Jackson ..... A61G 7/001
5/618
2009/0320206 A1* 12/2009 Dyreby ..... A47B 9/20
5/611

OTHER PUBLICATIONS

Great Britain Search Report issued in application No. GB1504206.
2, dated Aug. 21, 2015 (1 pg).

* cited by examiner

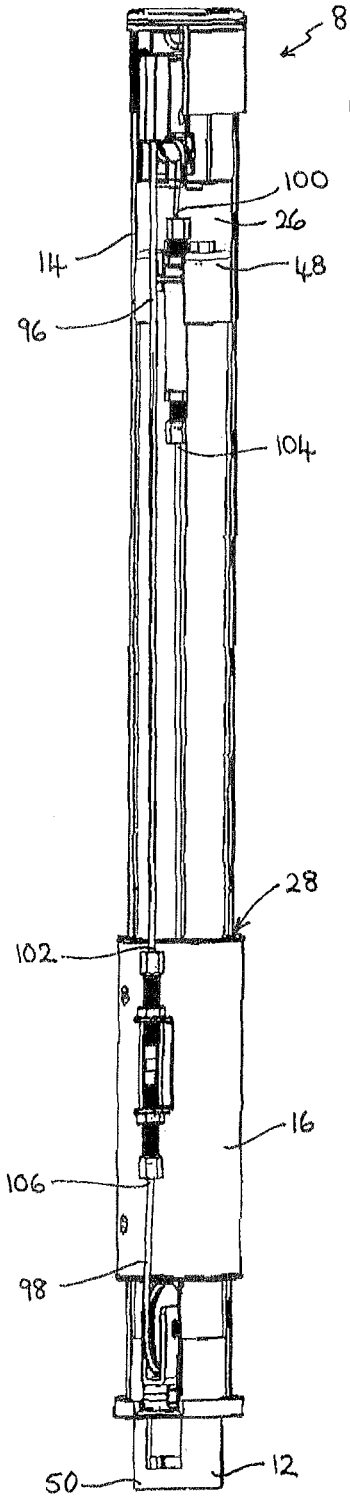
Fig. 9
Fig. 10
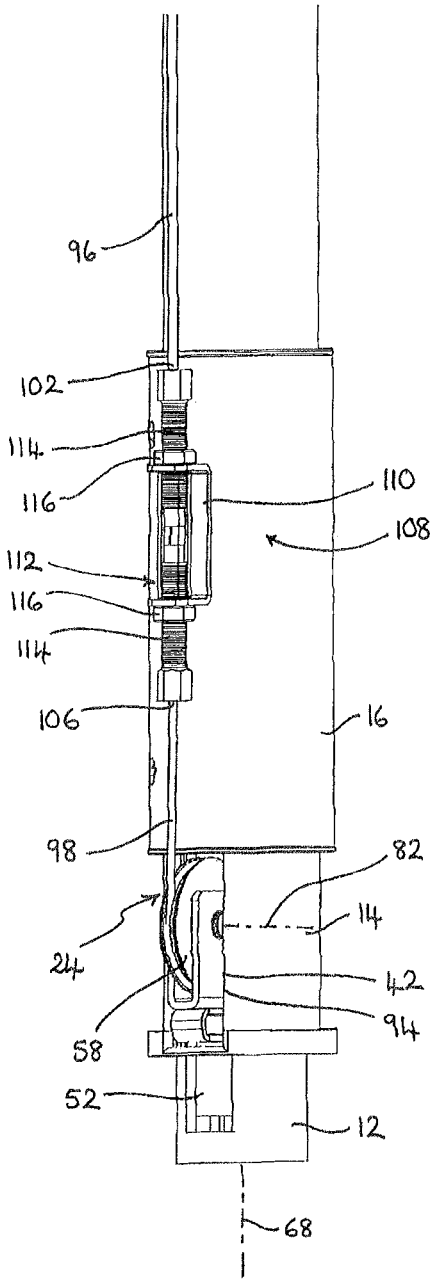

LIFTING MECHANISM

BACKGROUND a. Field of the Invention

This invention relates to lifting mechanisms. In particular this invention relates to lifting mechanisms for use in healthcare equipment such as beds.

b. Related Art

It is known to provide lifting mechanisms in beds in hospitals and other healthcare facilities. The lifting mechanisms are used to raise and lower the height of the bed, i.e. increase or decrease a distance between the mattress and the floor.

This may have the advantage of allowing the bed to be raised to a height at which a healthcare worker, such as a doctor or nurse, has easy access to the patient without bending. In some situations the lifting mechanisms also allow the bed to be lowered such that the mattress is close to the floor on which the bed is standing. This has the advantage that, if a patient rolls out of the bed, they will not fall a large distance to the floor. There is, therefore, a lower, risk of injury to the patient than if the bed was at a greater height.

A number of prior art lifting systems are known; however, these known systems have a number of disadvantages. In particular, some of these systems can be expensive to manufacture due to the large number of components and the complexity of the lifting mechanism. Other systems are bulky, taking up a lot of space at the end of the bed. These bulky systems not only significantly increase the size and weight of the bed, but also restrict access to the patient.

Furthermore, a known problem with a number of prior art mechanisms is the problem of entrapment. Because the lifting mechanisms necessarily involve moving parts, there is a risk that part of a person's body or clothing may become trapped between the moving parts, causing injury or damage. This is of particular concern for young people living with a disability or patients living with dementia.

It is an object of the present invention to provide an improved lifting mechanism that overcomes these disadvantages with prior art systems.

SUMMARY OF THE INVENTION

According to a first aspect of the present invention, there is provided a lifting assembly comprising:

- a telescopic post assembly including a first tubular member, a second tubular member slidingly engaged with the first tubular member, and a third tubular member slidingly engaged with the second tubular member, the first, second and third tubular members being coaxial;
- an actuator configured to move the second tubular member axially with respect to the first tubular member; and
- a pulley mechanism comprising:
  - a first wheel rotatably mounted at a first end of the second tubular member;
  - a second wheel rotatably mounted at a second end of the second tubular member;
  - a first length of cable having a first end fixed to the first tubular member and a second end fixed to the third tubular member, the first length of cable being engaged with the first wheel; and

- a second length of cable having a first end fixed to the first tubular member and a second end fixed to the third tubular member, the second length of cable being engaged with the second wheel,
- wherein the pulley mechanism is arranged such that the movement of the third tubular member relative to the first tubular member is at a greater speed than the movement of the second tubular member relative to the first tubular member.

The lifting assembly preferably further comprises tensioning means configured to apply a tensile force to the first and/or the second length of cable. The tensioning means may be configured such that the same tensile force is applied to both the first and the second length of cable. Alternatively, the tensioning means may be configured such that a different tensile force may be applied to each of the first length of cable and the second length of cable.

To improve the compactness of the lifting assembly, the pulley mechanism is preferably positioned at least partially within the second tubular member. This configuration also means that this part of the pulley mechanism is not exposed in use. In preferred embodiments at least a part of the first and/or the second length of cable extends through an axial bore of the second tubular member. To achieve this configuration the first wheel is preferably located in a slot in the second tubular member such that a first part of the first wheel is within a bore of the second tubular member and a second part of the first wheel extends beyond an outer surface of the second tubular member. Furthermore, the second wheel is preferably located in a slot in the second tubular member such that a first part of the second wheel is within a bore of the second tubular member and a second part of the second wheel extends beyond an outer surface of the second tubular member.

To lessen the risk of injury on the moving parts of the pulley mechanism, each of the first and second wheels are preferably mounted in a housing, with each housing being fixed to a respective end of the second tubular member.

In particularly preferred embodiments the first tubular member includes an axial slot, and the pulley mechanism is positioned at least partially within the first tubular member. In these embodiments at least a part of the first and/or the second length of cable may extend through an axial bore of the first tubular member. Furthermore, the second wheel preferably extends through the axial slot in the first tubular member such that a first part of the second wheel is within a bore of the first tubular member.

In some embodiments a part of each of the first and second length of cable extends along an outer surface of the second and/or the third tubular members. In these embodiments the lifting assembly preferably further comprises a shield member attached to the second tubular member and extending over said part of each of the first and second length of cable.

According to a second aspect of the present invention, there is provided a bed comprising:

- a first bed end and a second bed end;
- a substantially horizontal support for a mattress extending between the first and second bed ends; and
- a lifting mechanism associated with each of the first and second bed ends, the lifting mechanism comprising a telescopic post assembly including a first tubular member, a second tubular member slidingly engaged with the first tubular member, and a third tubular member slidingly engaged with the second tubular member, the first, second and third tubular members being coaxial; an actuator configured to move the second tubular member axially with respect to the first tubular member; and a pulley mechanism comprising a first wheel rotatably mounted at a first end of the second tubular member, a second wheel rotatably mounted at a second end of the second tubular member, a first length of cable having a first end fixed to the first tubular member and a second end fixed to the third tubular member, the first length of cable being engaged with the first wheel, and a second length of cable having a first end fixed to the first tubular member and a second end fixed to the third tubular member, the second length of cable being engaged with the second wheel, wherein the pulley mechanism is arranged such that the movement of the third tubular member relative to the first tubular member is at a greater speed than the movement of the second tubular member relative to the first tubular member, wherein the support for a mattress is connected to the third tubular member of each lifting mechanism.

Typically, each of the first and second bed ends includes two lifting mechanisms. In these embodiments, at each bed end, a cross member is fixed to and extends between each of the second tubular members and the actuator is connected to the cross member.

Preferably, a cap is removeably secured to an upper end of each of the second tubular members, each cap being configured to cover a bore of the second tubular member. The cap may comprise a first part releasably secured to the second tubular member and a second part releasably secured to the first part, the second part being configured to cover a means for securing the first part to the second tubular member.

According to a third aspect of the present invention, there is provided a method of constructing a lifting assembly comprising:

attaching a first end of a first length of cable to a first tubular member;

attaching a first end of a second length of cable to the first tubular member;

mounting a lower wheel at a lower end of a second tubular member;

locating the second tubular member around the first tubular member;

engaging the second length of cable with the lower wheel;

locating a third tubular member around the second tubular member;

mounting an upper wheel at an upper end of a second tubular member;

engaging the first length of cable with the upper wheel;

attaching a second end of the first length of cable to the third tubular member; and attaching a second end of the second length of cable to the third tubular member.

The second end of each of the first and second lengths of cable may be attached to the third tubular member by tensioning means. Alternatively or additionally the first end of each of the first and second lengths of cable may be attached to the first tubular member by tensioning means. In these embodiments the method preferably further comprises adjusting the tensioning means to apply a tensile force to the first and second lengths of cable.

In some embodiments the step of mounting the upper wheel comprises mounting the upper wheel in a housing and securing the housing to the upper end of the second tubular member. The step of securing the housing to the upper end of the second tubular member is preferably carried out after the second tubular member is located around the first tubular member and after the third tubular member is located around the second tubular member.

The second tubular member may include a slot at the upper end, and accordingly the method preferably comprises mounting the upper wheel such that the upper wheel extends through said slot at the upper end of the second tubular member. Alternatively or additionally the second tubular member may include a slot at the lower end and the first tubular member may include an axial slot. The method then preferably comprises mounting the lower wheel such that the lower wheel extends through said slot at the lower end of the second tubular member and said axial slot in the first tubular member.

Preferably the second ends of the first and second lengths of cable are attached to an outer surface of the third tubular member.

Preferably the first ends of the first and second lengths of cable are attached to the first tubular member in an axial bore of said first tubular member.

BRIEF DESCRIPTION OF THE DRAWINGS

The invention will now be further described by way of example only and with reference to the accompanying drawings, in which:

FIG. 9 is a view of the lifting mechanism of FIGS. 5 and 6 with a wall of the intermediate tubular member partially removed for clarity, and showing, in particular, the connection of the cable to the tubular members;

FIG. 10 is a view of part of the lifting mechanism of FIG. 9 showing the connection of the cable to an outer tubular member;

DETAILED DESCRIPTION

Figure 1:
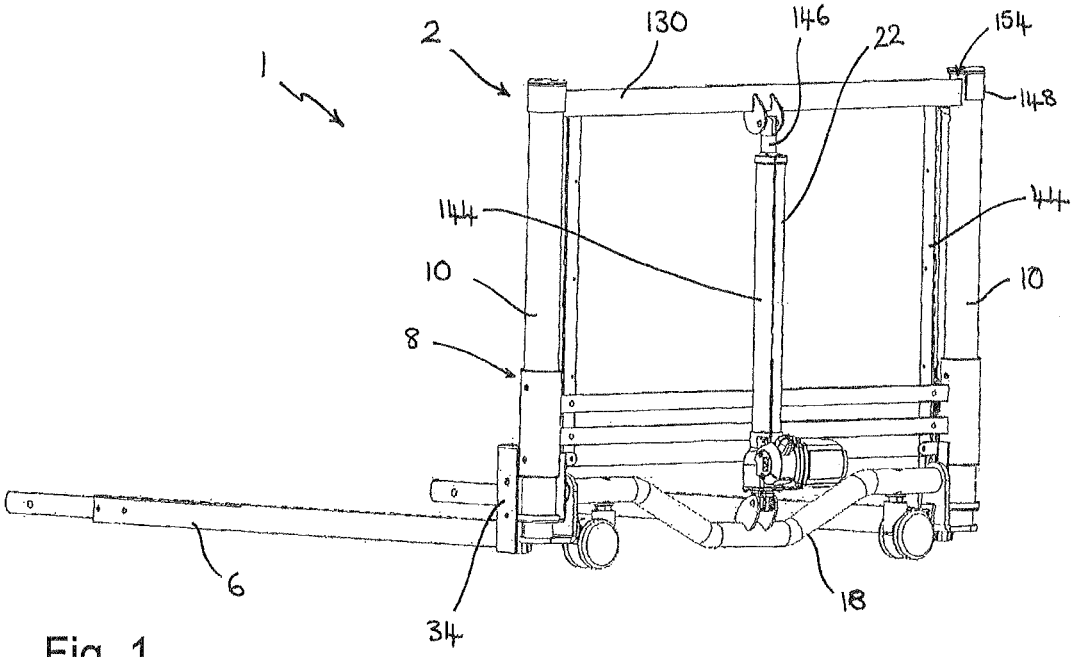
FIG. 1 is a perspective view from a first side of an end of a bed, including a lifting mechanism, according to a preferred embodiment of the present invention, the lifting mechanism being in a lowered position.
Figure 2:
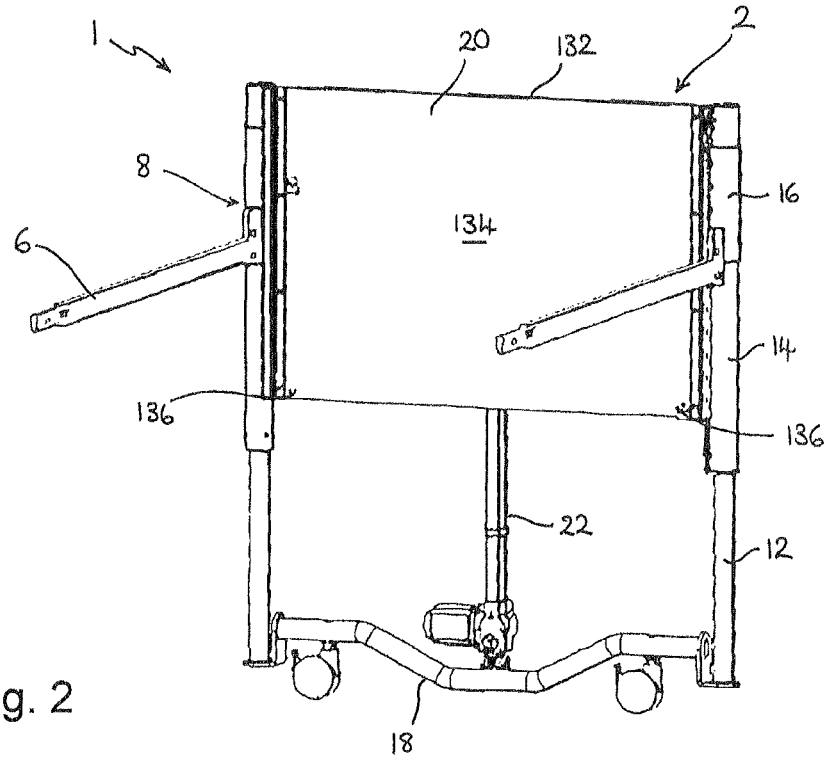
FIG. 2 is a perspective view of the bed end of FIG. 1, from a second side, with the lifting mechanism in a raised position.
Figure 3:
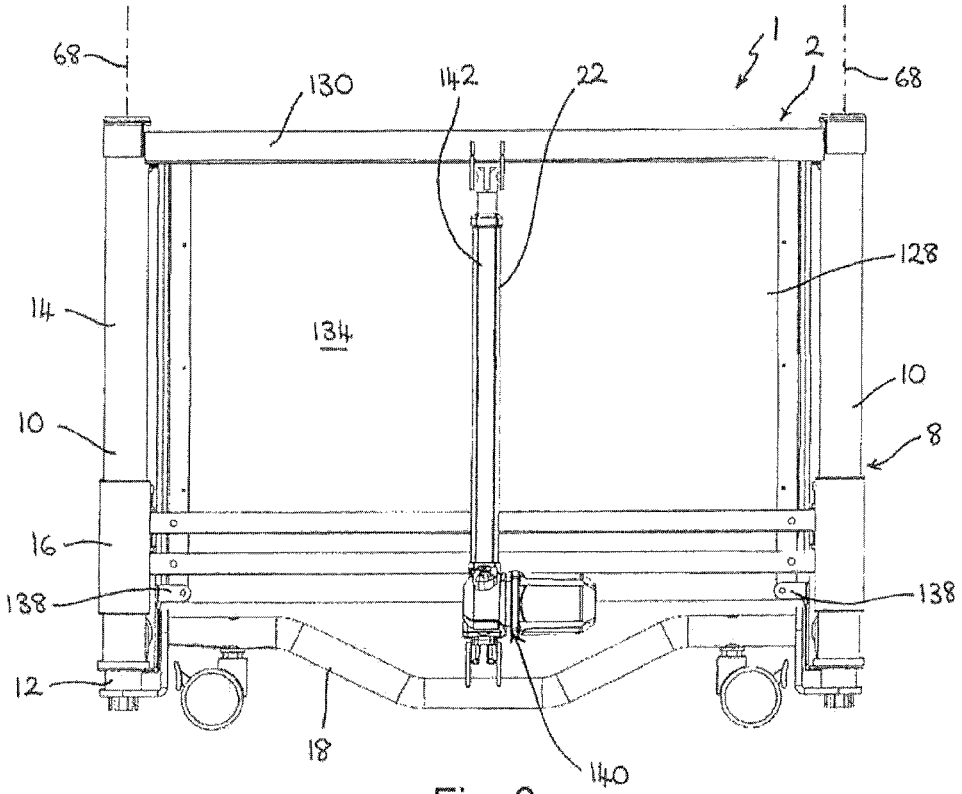
FIG. 3 is a plan view of the bed end of FIG. 1 from the first side.
Figure 4:
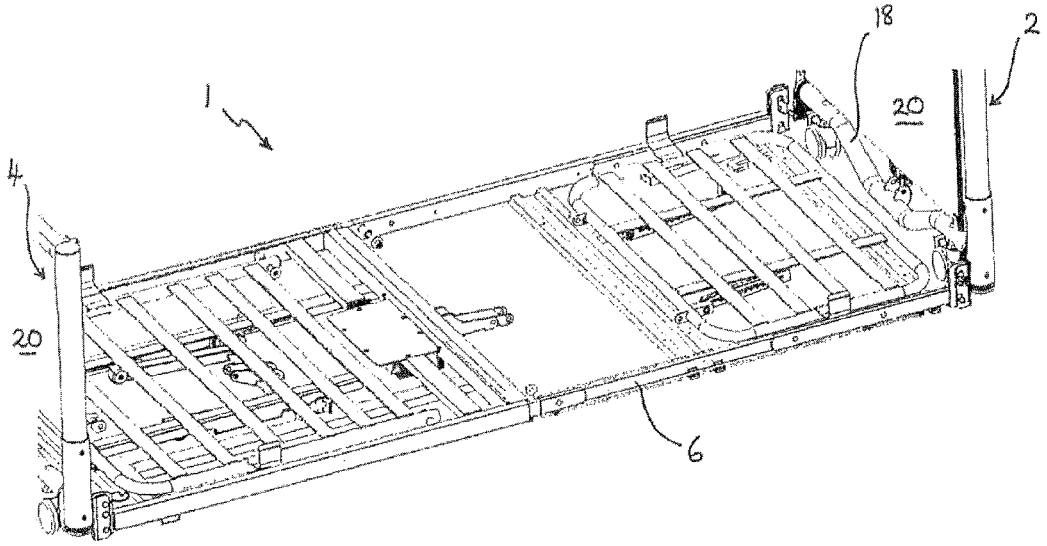
FIG. 4 is a view of a bed according to an embodiment of the present invention, showing a mattress support extending between two bed ends, the mattress support being in a lowered position.
Figure 5:
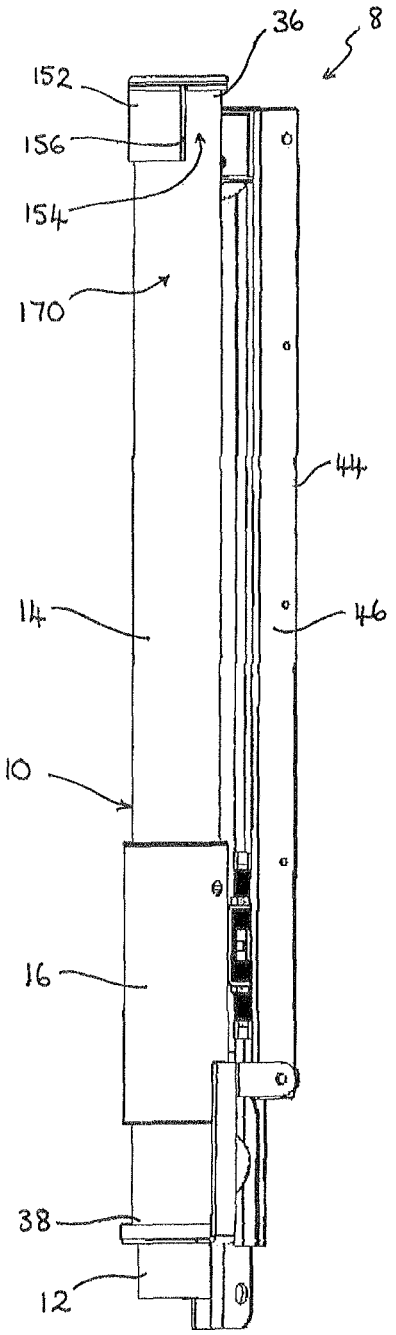
FIG. 5 shows a part of a lifting mechanism according to a preferred embodiment of the present invention, the lifting mechanism including pulley wheels and a cable.
Figure 6:
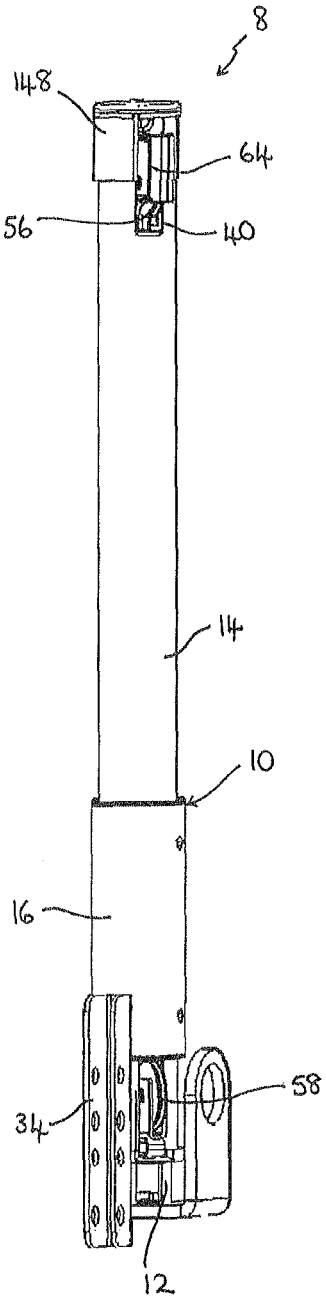
FIG. 6 shows the lifting mechanism of FIG. 5 with an outer cover plate and the cable removed for clarity, and showing in particular inner, outer and intermediate tubular members.
Figure 7:
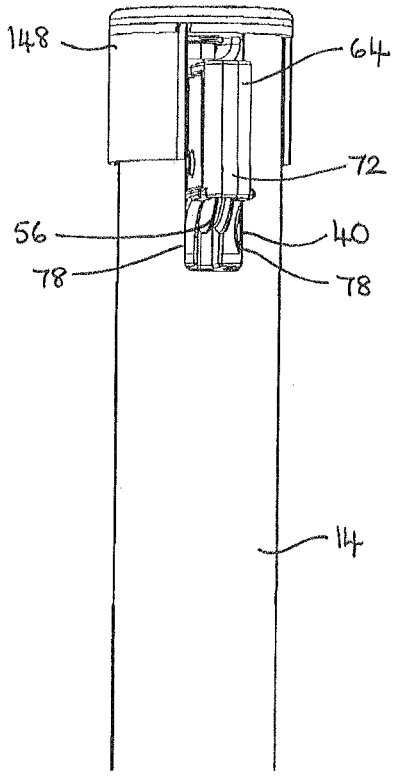
FIG. 7 shows detail of an upper end of the lifting mechanism of FIG. 6.
Figure 8:
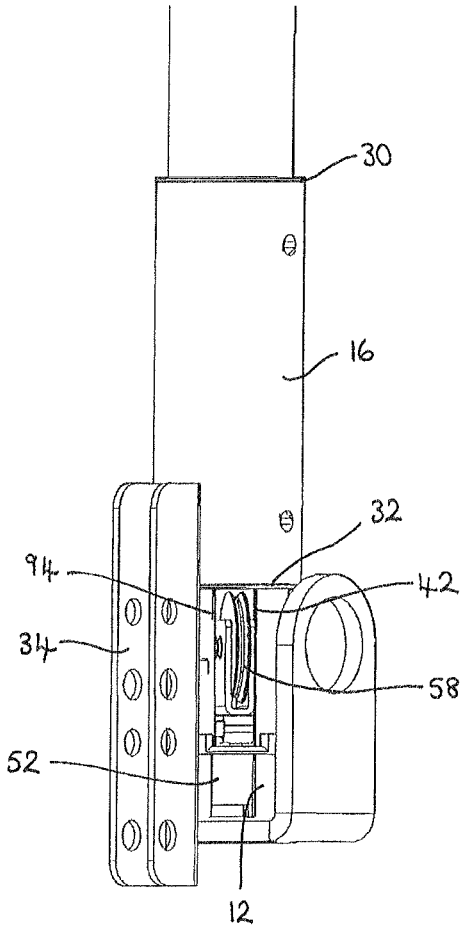
FIG. 8 shows detail of a lower end of the lifting mechanism of FIG. 6.
Figure 11:
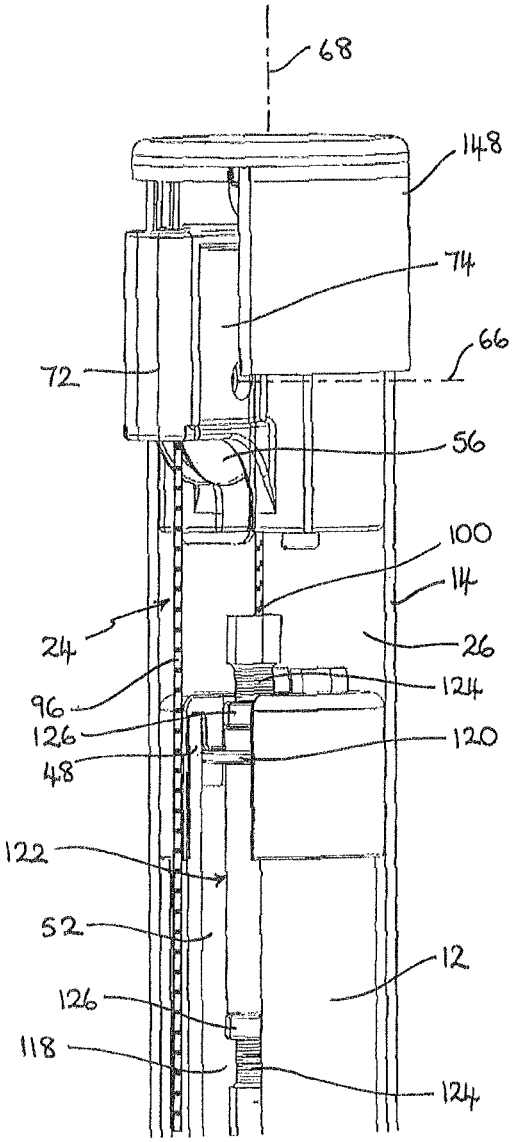
FIG. 11 is a view of part of the lifting mechanism of FIG. 9 showing the connection of the cable to an inner tubular member.
Figure 12:
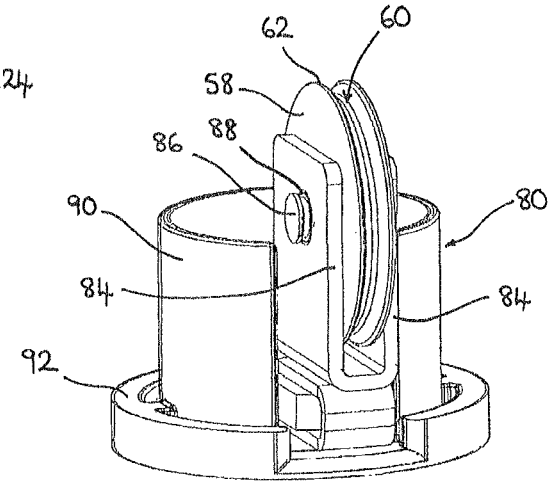
FIG. 12 shows a lower pulley wheel of the lifting mechanism of FIG. 5 and means for connecting the pulley wheel to an intermediate tubular member (not shown)
Figure 13:
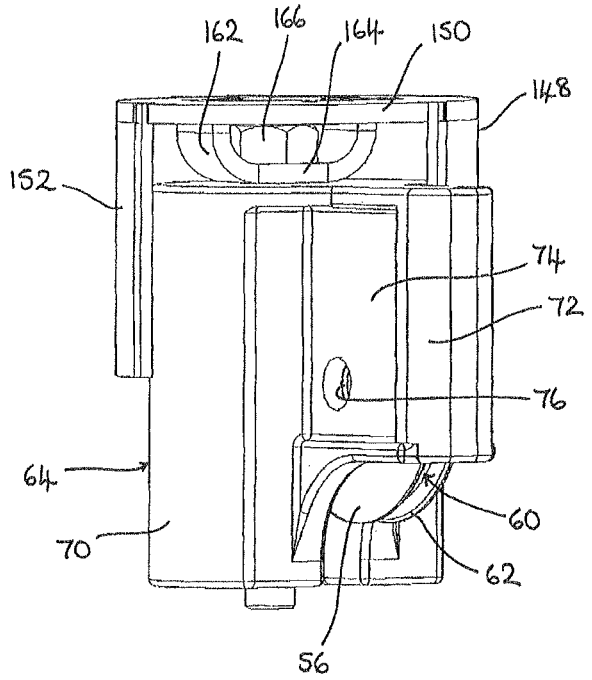
FIG. 13 shows an upper pulley wheel of the lifting mechanism of FIG. 5, a bracket for connecting the pulley wheel to the intermediate tubular member (not shown), and a cap of the intermediate tubular member.
Figure 14:
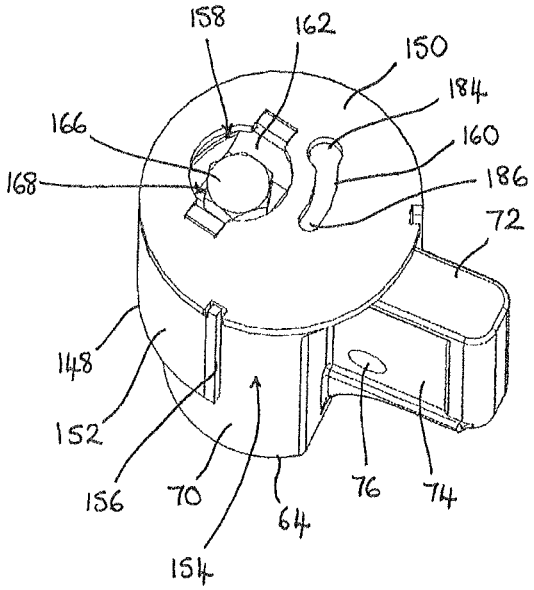
FIG. 14 is a view of the bracket and cap of FIG. 13.
Figure 15:
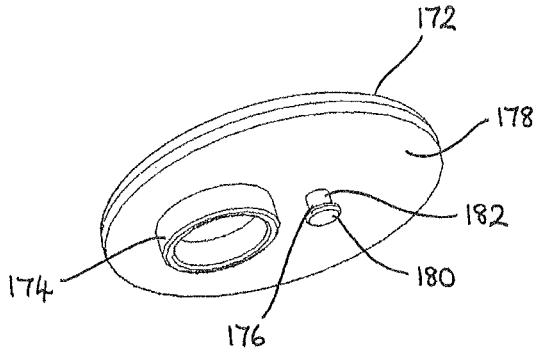
FIG. 15 is a view from the underside of a cover plate for the cap of FIG. 14.

FIGS. 1 to 4 show part of a bed assembly 1 according to a preferred embodiment of the present invention. The bed assembly 1 comprises two bed ends 2, 4, only one of which is shown in FIGS. 1 to 3, and a support 6 for a mattress extending between the bed ends 2, 4.

Each of the bed ends 2, 4 includes a lifting mechanism 8 that may be operated to raise and lower the mattress support 6 between a lowered position, shown in FIG. 1, in which the mattress support 6 is close to the floor, and a raised position, shown in FIG. 2, in which the mattress support 6 is at a greater distance from the floor than in the lowered position.

Details of parts of the lifting mechanism 8 are shown in FIGS. 5 to 15, but generally the lifting mechanism 8 comprises a telescopic post assembly 10 including three tubular members 12, 14, 16. A first tubular member 12 is connected to a base 18 of the bed, a second tubular member 14 is connected to a headboard or footboard 20 of the bed 1, and a third tubular member 16 is connected to the mattress support 6. An actuator 22 acts on the second tubular member 14 so as to slidingly move the second tubular member 14 with respect to the first tubular member 12. In addition, a pulley mechanism 24 operatively engaged with the tubular members 12, 14, 16 causes the third tubular member 16 to slidingly move with respect to the second tubular member 14. In this way, as the telescopic post assembly is extended both the headboard or footboard 20 and the mattress support 6 are raised with respect to the base 18 of the bed 1. Furthermore, the pulley mechanism 24 is configured such that the mattress support 6 is raised at a greater speed than the headboard or footboard 20.

A benefit of the combined use of an actuator 22 and pulley mechanism 24 is that the mattress support 6 may be lowered to a position very close to the ground, as shown in FIG. 1. This has the advantage that the bed may be lowered for patients that are prone to falling out of bed, so as to reduce the risk of injury to the patient if this should occur.

As shown most clearly in FIGS. 5 to 11, in a preferred embodiment of the lifting mechanism 8, the first, second and third tubular members 12, 14, 16 are coaxially arranged. The tubular members 12, 14, 16 are cylindrical, and the first tubular member 12 is received in an axial bore 26 of the second tubular member 14, and the second tubular member 14 is received in an axial bore 28 of the third tubular member 16. The internal and external diameters of each of the tubular members 12, 14, 16 are such that the second tubular member 14 is slidingly moveable along the first tubular member 12 and the third tubular member 16 is slidingly moveable along the second tubular member 14.

The third tubular member 16, or outer tubular member, is a complete tube and fully surrounds the second tubular member 14; however, the length of the third tubular member 16, between first and second ends 30, 32, is substantially less than the length of the second tubular member 14.

A bracket 34 is attached to the third tubular member 16. The mattress support 6 is connected to this bracket 34 such that movement of the third tubular member 16 results in movement of the mattress support 6.

The second tubular member 14, or intermediate tubular member, extends between a first end 36 and a second end 38. A first axial slot 40 is formed in a wall of the second tubular member 14 and extends from the first end 36. A second axial slot 42 is formed in the wall of the second tubular member 14 and extends from the second end 38. The first and second axial slots 40, 42 are sized to provide clearance for first and second wheels 56, 58 of the pulley mechanism 24. In this example the first and second slots 40, 42 are in line with each other.

The first tubular member 12, or inner tubular member, extends between a first end 48 and a second end 50. An axial slot 52 is formed in a wall of the first tubular member 12 and extends from the first end 48 for at least substantially the whole length of the first tubular member 12. In preferred embodiments the slot 52 does not extend fully to the second end 50 of the tubular member 12 so that an end region of the tubular member 12 is a complete tube.

The pulley mechanism 24 comprises a first wheel 56 and a second wheel 58. In this embodiment, both of the first and second wheels 56, 58 are pulley wheels having a circumferential groove 60 in a rim 62 for receiving a cord or cable. In other embodiments, however, the wheels may be sprocket wheels for engaging with a chain or similar. Both of the first and second wheels 56, 58 are secured to the second tubular member 14.

The first wheel 56 is mounted for rotation in a housing 64 at the first end 36 of the second tubular member 14 such that a rotational axis 66 of the first wheel 56 is perpendicular to a longitudinal axis 68 of the second tubular member 14. The housing 64, shown most clearly in FIG. 13, comprises a generally cylindrical body portion 70 and a carriage portion 72 extending radially outwards from the body portion 70. The carriage portion 72 includes a pair of spaced apart side walls 74 between which the first wheel 56 is located. An axle (not shown) of the first wheel 56 is retained at each of its ends in a hole 76 in a respective one of the side walls 74.

In this way, the housing 64 surrounds and encloses the majority of the first wheel 56 and, in particular, fully surrounds and encloses an upper half of the wheel 56 nearest to the first end 36 of the second tubular member 14.

When the housing 64 is mounted in and secured to the second tubular member 14 a part of the carriage portion 72, and therefore a part of the first wheel 56, extends through the slot 40 in the wall of the second tubular member 14. In this embodiment, longitudinal edges 78 of the slot 40 intersect the rotational axis 66 of the first wheel 56.

The second wheel 58 is mounted for rotation in a housing 80 at the second end 38 of the second tubular member 14 such that a rotational axis 82 of the second wheel 58 is perpendicular to the longitudinal axis 68 of the second tubular member 14. The housing 80, shown most clearly in FIG. 12, comprises a pair of spaced apart support plates 84, between which the second wheel 58 is located. An axle 86 of the second wheel 58 is retained at each of its ends in a hole 88 in a respective one of the support plates 84.

The housing 80 further comprises a cylindrical outer wall 90 with an outwardly extending flange 92 at one end. The outer diameter of the outer wall 90 is substantially the same as the diameter of the bore 26 of the second tubular member 14. The housing 80 is mounted in and secured to the second tubular member 14 such that the outer wall 90 extends into the bore 26 of the tubular member 14 and the flange 92 contacts the second end 38 of the tubular member 14. In this position a part of the support plates 84, and therefore a part of the second wheel 58, extends through the slot 42 in the wall of the second tubular member 14. In this embodiment, longitudinal edges 94 of the slot 42 intersect the rotational axis 82 of the second wheel 56.

The pulley mechanism 24 further comprises two lengths of cable 96, 98. The cable may be in the form of a cord or chain. A first length of cable 96 has a first end 100 secured to the first tubular member 12 and a second end 102 fixed to the third tubular member 16. The first length of cable 96 extends over and is engaged with the first wheel 56. The part of the first length of cable 96 that is engaged with the wheel 56 is located in the groove 60 in the rim 62 of the wheel 56. A second length of cable 98 has a first end 104 secured to the first tubular member 12 and a second end 106 fixed to the third tubular member 16. The second length of cable 98 extends around and is engaged with the second wheel 58. The part of the second length of cable 98 that is engaged with the wheel 58 is located in the groove 60 in the rim 62 of the wheel 58.

As shown most clearly in FIG. 10, the second end 102, 106 of each of the lengths of cable 96, 98 is secured to an outer surface 108 of the third tubular member 16. In this embodiment a bracket 110 is fixed to the outer surface 108 of the third tubular member 16 and the second ends 102, 106 of the lengths of cable 96, 98 are secured to the bracket 110 by tensioning means 112. The tensioning means 112 includes a male threaded shaft 114 attached to each of the second ends 102, 106 of the lengths of cable 96, 98 and a retaining member 116, engaged with the bracket 110, having a female threaded aperture. The tensioning means 112 preferably includes two retaining members 116, each having a threaded aperture. The threaded shaft 114 at each of the second ends 102, 106 of the lengths of cable 96, 98 is engaged with a respective retaining member 116 by means of the threaded aperture.

The second ends 102, 106 are connected to the third tubular member 16 such that they are in line with each other and end regions of the first and second lengths of cable 96, 98 proximate the respective second ends 102, 106 extend away from the bracket 110 in opposite directions.

The first end 100, 104 of each of the lengths of cable 96, 98 is secured to the first tubular member 12 such that at least one of the first ends 100, 104 is located within an axial bore 118 of the first tubular member 12. In this embodiment a bracket 120 is mounted within the bore 118 of the first tubular member 12 and the first ends 100, 104 of the lengths of cable 96, 98 are secured to the bracket 120 by tensioning means 122. The tensioning means 122 includes a male threaded shaft 124 attached to each of the first ends 100, 104 of the lengths of cable 96, 98 and a retaining member 126, engaged with the bracket 120, having a female threaded aperture. The tensioning means 122 preferably includes two retaining members 126, each having a threaded aperture. The threaded shaft 124 at each of the first ends 100, 104 of the lengths of cable 96, 98 is engaged with a respective retaining member 126 by means of the threaded aperture.

The first ends 100, 104 are connected to the first tubular member 12 such that they are in line with each other and end regions of the first and second lengths of cable 96, 98 proximate the respective first ends 100, 104 extend away from the bracket 120 in opposite directions. Furthermore, in this embodiment, the first end 100, 104 of each of the lengths of cable 96, 98 lies on a longitudinal axis 68 of the first tubular member 12.

A tensile force is applied to each of the lengths of cable 96, 98 by screwing the respective male threaded shaft 114, 124 into or through the respective female threaded aperture of the retaining member 116, 126 at both ends 100, 102, 104, 106 of each of the lengths of cable 96, 98. By providing separate tensioning means 112, 122 at the first ends 100, 104 of the lengths of cable 96, 98 and the second ends 102, 106 of the lengths of cable 96, 98 a different tensile force may be applied to each of the lengths of cable 96, 98.

It may be desirable, however, to apply equal tensile forces to the two lengths of cable 96, 98. While this may be achieved with the arrangement described above, it may be beneficial in some embodiments if the pulley mechanism includes a single cable and only a single tensioning means is provided. In these embodiments a mid point of the cable is fixed to the first tubular member, and each end of the cable is secured to the third tubular member by suitable tensioning means, such as those described above. In this way, a first length of the cable extends between the fixed mid-point and one end of the cable and a second length of the cable extends between the fixed mid-point and the other end of the cable. It will be appreciated that in other embodiments the mid-point of the cable may be fixed to the third tubular member and the ends of the cable may be secured to the first tubular member.

With the arrangement of the wheels 56, 58 and the lengths of cable 96, 98 described above, it is apparent that part of each of the wheels 56, 58 and a section of each of the lengths of cable 96, 98 are located exterior to the second and third tubular members 14, 16. To minimise the risk of entrapment, i.e. a part of a person, clothing or equipment being caught in the pulley mechanism 24, a shield member 44 is secured to the second tubular member 14. The shield member 44 comprises a shaped elongate strip 46 that extends for substantially the full length of the second tubular member 14 and substantially covers the exposed sections of the lengths of cable 96, 98.

The arrangement of the pulley mechanism 24 is such that as the second, intermediate tubular member 14 is slid along the first, inner tubular member 12, the first and second lengths of cable 96, 98 pass over the respective wheels 56, 58 and cause the third, outer tubular member 16 to slide along the second tubular member 14. The speed of movement of the third tubular member 16 is greater than the speed of movement of the second tubular member 14. Preferably, the pulley mechanism 24 is configured so that the speed of movement of the third tubular member 16 is twice as fast as the speed of movement of the second tubular member 14.

Furthermore, it will be appreciated that as the second tubular member 14 is raised by the action of the actuator 22, the second wheel 58 moves up through the axial slot 52 in the first tubular member 12.

Returning to FIGS. 1 and 3, the lifting mechanism 8 at each end 2, 4 of the bed 1 includes two telescopic post assemblies 10 spaced apart across a width of the bed 1, each post assembly 10 having an associated pulley mechanism 24. The telescopic post assemblies 10 are oriented such that a longitudinal axis 68 of each post assembly 10 is substantially vertical. A board assembly 128 extends between the post assemblies 10 and forms a headboard or a footboard 20 at the respective end 2, 4 of the bed 1.

An elongate support member 130 of the board assembly 128 extends substantially horizontally between the post assemblies 10 and is connected at each of its ends to a respective one of the second tubular members 14. In this embodiment the support member 130 is connected to each second tubular member 14 proximate the first, upper end 36 of the second tubular member 14. An upper edge 132 of a substantially rectangular panel or board 134 is fixed to the support member 130. Lower corners 136 of the panel 134 are fixed to brackets 138 that are connected to a respective one of the second tubular members 14 at the second end 38 of the second tubular member 14.

The actuator 22 is mounted on the base 18 of the bed 1 and is connected to the support member 130. The actuator 22 is a linear actuator and comprises a motor 140 that drives a piston 142. The piston tube 144 is fixed to the base 18 of the bed 1 and the piston rod 146 is connected to the support member 130. As such, as the piston rod 146 extends from the piston tube 144, the support member 130 is raised or moved in a direction away from the base 18 of the bed 1. As the piston rod 146 retracts into the tube 144 the support member 130 is lowered or moved in a direction towards the base 18 of the bed 1. Consequently the second tubular member 14 of each of the post assemblies 10 is also either raised or lowered on the respective first tubular member 12.

In use, when a user wishes to raise the mattress of the bed 1, the actuator 22 is activated to extend the piston rod 146 from the piston tube 144. This raises the second tubular members 14 of the post assemblies 10. The action of the pulley mechanisms 24 result in the movement of the third tubular members 16 with respect to the second tubular members 14 in a direction towards the first ends 36 of the second tubular members 14 and the raising of the mattress support 6. Similarly, when a user wishes to lower the mattress of the bed 1, the actuator 22 is activated to retract the piston rod 146 into the piston tube 144. This lowers the second tubular members 14 of the post assemblies 10. The action of the pulley mechanisms 24 result in the movement of the third tubular members 16 with respect to the second tubular members 14 in a direction towards the second ends 38 of the second tubular members 14 and the lowering of the mattress support 6.

To construct the arrangement of the pulley mechanism 24 and telescopic post assembly 10 described above the first, inner tubular member 12 is connected at its second end 50 to the base 18 of the bed 1. The first ends 100, 104 of the lengths of cable 96, 98 are then attached to the inner tubular member 12 by the tensioning means 122.

The second wheel 58 is mounted at the second end 38 of the second, intermediate tubular member 14 in its housing 80. The intermediate tubular member 14 is then slid down over the inner tubular member 12 such that the second wheel 58 extends through the slot 52 in the inner tubular member 12. The second length of cable 98 is threaded around the second wheel 58 such that it extends out through the slot 52 in the inner tubular member 12 and through the slot 42 in the second, lower end 38 of the intermediate tubular member 14.

The third, outer tubular member 16 is then slid down over the intermediate tubular member 14.

The first length of cable 96 is positioned such that it extends from the first end 48 of the inner tubular member 12 and the first end 36 of the intermediate tubular member 14. The first length of cable 96 is then wrapped around the first wheel 56 mounted in its housing 64. Once the first length of cable 96 has been engaged with the first wheel 56, the housing 64 is secured to the intermediate tubular member 14 at the first end 36 of the intermediate tubular member 14 such that the carriage portion 72 of the housing 64 extends outwards through the slot 40 in the intermediate tubular member 14.

The second ends 102, 106 of the first and second lengths of cable 96, 98 are then connected to the outer tubular member 16 by the tensioning means 112. The lengths of cable 96, 98 may then be adjusted to be of the required tension.

To cover the housing 64 and the upper end 36 of the intermediate tubular member 14, a cap 148 is fitted over the first end 36 of the intermediate tubular member 14. The cap 148, shown most clearly in FIGS. 13 and 14, comprises a securing plate 150 and a side wall 152 that extends from a periphery of the securing plate 150. The side wall 152 extends in a direction substantially perpendicular to the securing plate 150 and does not extend around the full periphery of the plate 150. A gap 154 is, therefore, defined between two opposing end edges 156 of the side wall 152.

A width of the gap 154, i.e. the distance between the end edges 156 of the side wall 152, is at least as large as the width of the slot 40 in the second tubular member 14 through which the housing 64 extends. In the illustrated embodiment the gap 154 is of sufficient width to accommodate both the carriage portion 72 of the housing 64 and the support member 130 that is attached to the second tubular member 14, as shown most clearly in FIGS. 1 and 14.

The securing plate 150 includes an aperture 158 and an elongate slot 160. A mounting strip 162 is connected to the securing plate 150. The mounting strip 160 is formed into a U-shape and is attached to the securing plate 150 at each of its ends and extends from the securing plate 150 in the same direction as the side wall 152. A central section 164 of the mounting strip 162 is flat and extends substantially parallel to the securing plate 150. A hole is provided in the central section 164 of the mounting strip 162 and is aligned with the aperture 158 in the securing plate 150. The diameter of the aperture 158 is greater than the diameter of the hole. Preferably the diameter of the aperture 158 is larger than the maximum diameter of a head 166 of a bolt 168 and the diameter of the hole is larger then the maximum diameter of a shaft of the bolt 168 but smaller than the diameter of the head 166 of the bolt 168.

To secure the cap 148 to the second tubular member 14, the cap 148 is fitted over the first end 36 so that the side wall 152 of the cap 148 extends downwards over an outer surface 170 of the second tubular member 14. The bolt 168 is then inserted down through the aperture 158 and the hole and secured to the housing 64. The larger diameter of the aperture 158 provides access to the head 166 of the bolt 168 to enable it to be screwed into the housing 64 with the head 166 of the bolt 168 seated below the securing plate 150.

To cover the bolt 168 and aperture 158, a cover plate 172 is provided. The cover plate 172, shown in FIG. 15, includes an alignment projection 174 and a retaining peg 176, both extending from a first side 178 of the cover plate 172. The alignment projection 174 is sized to be received in the aperture 158 of the cap 148 and, preferably, the size and shape of the outer periphery of the projection 174 is substantially the same as the size and shape of the periphery of the aperture 158. The peg 176 is substantially T-shaped, comprising a distal end portion 180 having a larger diameter than a stem portion 182. The peg 176 is sized and shaped to engage with the slot 160 in the cap 148, so as to retain the cover plate 172 on the cap 148. In particular, the peg 176 may be inserted through the slot 160 at a first end 184 of the slot 160 and then moved along the length of the slot 160 to a second end 186. At the second end 186 of the slot 160 the width of the slot 160 is smaller than the diameter of the end portion 180 of the peg 176 such that the peg 176 is retained in the slot 160.

The positioning of the projection 174 and peg 176 on the cover plate 172 corresponds to the position of the aperture 158 and slot 160 in the cap 148. In this way, the projection 174 may be located in the aperture 158 and the peg 176 located in the first end 184 of the slot 160. The cover plate 172 can then be rotated with respect to the cap 148, with the projection 174 remaining in the aperture 158, to move the peg 176 to the second end 186 of the slot 160. In this retained position, a periphery of the cover plate 172 is aligned with a periphery of the securing plate 150 of the cap 148.

Although in this embodiment the cap 148 is secured to the second tubular member 14 by means of a bolt 168, it will be appreciated that in other embodiments other suitable fastening means may be used.

The lifting mechanism or assembly of the present invention, therefore, has a compact yet rigid structure that minimises the exposure of the pulley mechanism. The assembly requires a minimal number of parts and is, therefore, relatively cost effective to manufacture, while providing important benefits in minimising the risk of entrapment and allowing, when used in a bed assembly, a large range of movement of a mattress support.

The invention claimed is:

1. A lifting assembly comprising:

a telescopic post assembly including a first tubular member, a second tubular member slidingly engaged with the first tubular member, and a third tubular member slidingly engaged with the second tubular member, the first, second and third tubular members being coaxial;

an actuator configured to move the second tubular member axially with respect to the first tubular member; and a pulley mechanism comprising:

a first wheel rotatably mounted at a first end of the second tubular member;

a second wheel rotatably mounted at a second end of the second tubular member;

a first length of cable having a first end fixed to the first tubular member and a second end fixed to the third tubular member, the first length of cable being engaged with the first wheel; and a second length of cable having a first end fixed to the first tubular member and a second end fixed to the third tubular member, the second length of cable being engaged with the second wheel, wherein the pulley mechanism is arranged such that the movement of the third tubular member relative to the first tubular member is at a greater speed than the movement of the second tubular member relative to the first tubular member.

2. A lifting assembly as claimed in claim 1, wherein a part of each of the first and second length of cable extends along an outer surface of the second and/or the third tubular members, and wherein the lifting assembly further comprises a shield member attached to the second tubular member and extending over said part of each of the first and second length of cable.

3. A lifting assembly as claimed in claim 1 further comprising tensioning means configured to apply a tensile force to the first and/or the second length of cable.

4. A lifting assembly as claimed in claim 3, wherein the tensioning means is configured such that the same tensile force is applied to both the first and the second length of cable.

5. A lifting assembly as claimed in claim 3, wherein the tensioning means is configured such that a different tensile force may be applied to each of the first length of cable and the second length of cable.

6. A lifting assembly as claimed in claim 1, wherein the first tubular member is an inner tubular member, the second tubular member is an intermediate tubular member and the third tubular member is an outer tubular member, such that the first tubular member is received in an axial bore of the second tubular member and the second tubular member is received in an axial bore of the third tubular member.

7. A lifting assembly as claimed in claim 6, wherein the pulley mechanism is positioned at least partially within the second tubular member.

8. A lifting assembly as claimed in claim 7, wherein the first wheel is located in a slot in the second tubular member such that a first part of the first wheel is within a bore of the second tubular member and a second part of the first wheel extends beyond an outer surface of the second tubular member.

9. A lifting assembly as claimed in claim 7, wherein the second wheel is located in a slot in the second tubular member such that a first part of the second wheel is within a bore of the second tubular member and a second part of the second wheel extends beyond an outer surface of the second tubular member.

10. A lifting assembly as claimed in claim 7, wherein at least a part of the first and/or the second length of cable extends through an axial bore of the second tubular member.

11. A lifting assembly as claimed in claim 6, wherein the first tubular member includes an axial slot, and wherein the pulley mechanism is positioned at least partially within the first tubular member.

12. A lifting assembly as claimed in claim 11, wherein at least a part of the first and/or the second length of cable extends through an axial bore of the first tubular member.

13. A lifting assembly as claimed in claim 11, wherein the second wheel extends through the axial slot in the first tubular member such that a first part of the second wheel is within a bore of the first tubular member.

14. A lifting assembly as claimed in claim 1, wherein each of the first and second wheels are mounted in a housing, and each housing is fixed to a respective end of the second tubular member.

15. A bed comprising:

a first bed end and a second bed end;

a substantially horizontal support for a mattress extending between the first and second bed ends; and a lifting mechanism associated with each of the first and second bed ends, the lifting mechanism comprising a telescopic post assembly including a first tubular member, a second tubular member slidingly engaged with the first tubular member, and a third tubular member slidingly engaged with the second tubular member, the first, second and third tubular members being coaxial; an actuator configured to move the second tubular member axially with respect to the first tubular member; and a pulley mechanism comprising a first wheel rotatably mounted at a first end of the second tubular member, a second wheel rotatably mounted at a second end of the second tubular member, a first length of cable having a first end fixed to the first tubular member and a second end fixed to the third tubular member, the first length of cable being engaged with the first wheel, and a second length of cable having a first end fixed to the first tubular member and a second end fixed to the third tubular member, the second length of cable being engaged with the second wheel, wherein the pulley mechanism is arranged such that the movement of the third tubular member relative to the first tubular member is at a greater speed than the movement of the second tubular member relative to the first tubular member, wherein the support for a mattress is connected to the third tubular member of each lifting mechanism.

16. A bed as claimed in claim 15, wherein the first tubular member is an inner tubular member, the second tubular member is an intermediate tubular member and the third tubular member is an outer tubular member, such that the first tubular member is received in an axial bore of the second tubular member and the second tubular member is received in an axial bore of the third tubular member.

17. A bed as claimed in claim 16, wherein each of the first and second bed ends includes two lifting mechanisms, and wherein at each bed end a cross member is fixed to and extends between each of the second tubular members and the actuator is connected to the cross member.

18. A bed as claimed in claim 16, further comprising a cap removeably secured to an upper end of each of the second tubular members, each cap being configured to cover a bore of the second tubular member.

19. A bed as claimed in claim 18, wherein the cap comprises a first part releasably secured to the second tubular member and a second part releasably secured to the first part, the second part being configured to cover a means for securing the first part to the second tubular member.

* * * * *